US006701557B2

(12) United States Patent
Barman

(10) Patent No.: US 6,701,557 B2
(45) Date of Patent: Mar. 9, 2004

(54) SINGLE PIECE FOAM TOPPERS WITH PERIMETER AREAS HAVING VARIABLE SUPPORT AND FIRMNESS PROPERTIES

(75) Inventor: Bruce G. Barman, Greensboro, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 09/996,457

(22) Filed: Nov. 29, 2001

(65) Prior Publication Data

US 2003/0097715 A1 May 29, 2003

(51) Int. Cl.[7] ..... A47C 27/14; A47C 27/05

(52) U.S. Cl. ..... 5/730; 5/736; 5/740; 5/721; 5/901

(58) Field of Search ..... 5/716, 717, 721, 5/727, 739, 740, 654.1, 655.7, 655.9, 642, 230, 248, 256, 900.5, 901, 953, 730, 736, 944; 267/91

(56) References Cited

U.S. PATENT DOCUMENTS

| | | | | | |
|---|---|---|---|---|---|
| 1,915,659 | A | | 6/1933 | Gail | |
| 2,069,415 | A | | 2/1937 | Lotz | |
| 2,319,431 | A | | 5/1943 | Owen | |
| 2,399,628 | A | | 5/1946 | Cunningham | |
| 3,521,311 | A | | 7/1970 | Cohen | |
| 3,828,378 | A | * | 8/1974 | Flam | 5/730 |
| 4,042,987 | A | * | 8/1977 | Rogers | 5/730 |
| 4,070,719 | A | * | 1/1978 | Morgan | 5/736 |
| 4,073,020 | A | * | 2/1978 | Stalter et al. | 5/736 X |
| 4,110,881 | A | * | 9/1978 | Thompson | 29/91.1 |
| 4,213,214 | A | | 7/1980 | Gilhooly | |
| 4,286,344 | A | | 9/1981 | Ikeda | |
| 4,389,743 | A | | 6/1983 | Callaway | |
| 4,603,445 | A | * | 8/1986 | Spann | 5/736 |
| 4,679,266 | A | | 7/1987 | Kraft | |
| 4,879,776 | A | * | 11/1989 | Farley | 5/736 X |
| 4,955,096 | A | * | 9/1990 | Gilroy et al. | 5/730 |
| 5,038,433 | A | * | 8/1991 | Farley | 5/730 |
| 5,077,849 | A | * | 1/1992 | Farley | 5/730 |
| 5,107,558 | A | | 4/1992 | Luck | |
| 5,111,542 | A | * | 5/1992 | Farley | 5/727 |
| 5,113,539 | A | | 5/1992 | Strell | |
| 5,134,735 | A | * | 8/1992 | Rose | 5/730 |
| 5,136,740 | A | * | 8/1992 | Kraft | 5/730 |
| 5,230,110 | A | * | 7/1993 | Rose | 5/736 X |
| 5,317,768 | A | * | 6/1994 | Klancnik | 5/736 |
| 5,327,597 | A | * | 7/1994 | Rothbard | 5/901 X |
| 5,353,455 | A | * | 10/1994 | Loving et al. | 5/730 |
| 5,430,901 | A | * | 7/1995 | Farley | 5/730 |
| 5,469,590 | A | * | 11/1995 | Simon | 5/721 |

(List continued on next page.)

FOREIGN PATENT DOCUMENTS

| | | | | |
|---|---|---|---|---|
| FR | 2220238 A | * | 10/1974 | 5/730 |
| FR | 2646772 A1 | * | 11/1990 | 5/730 |
| GB | 1559851 A | * | 1/1980 | 5/730 |

*Primary Examiner*—Robert G. Santos
(74) *Attorney, Agent, or Firm*—Roetzel & Andress

(57) ABSTRACT

A selectively contoured single unibody foam piece for use as a layer in a cushioned load bearing structure has a first zone with a first surface topography having distinct support properties from a second zone with a second surface topography. The zones of differing topography are formed in the surface of a single, unibody piece of foam by applicable foam cutting techniques. Patterned removal of foam material from a single piece creates zones with different density, ILD or other load bearing properties with different support and feel characteristics. A single unibody component in a responsive flexible support structure has distinct zones with distinct support characteristics, the zones corresponding in location with the anticipated loads and loading patterns of a flexible support device in use.

3 Claims, 3 Drawing Sheets

U.S. PATENT DOCUMENTS 5,579,549 A * 12/1996 Selman et al. ..... 5/721
D381,543 S * 7/1997 Farley ..... 5/736 X
5,671,492 A * 9/1997 Simon ..... 5/736 X
5,701,623 A 12/1997 May
5,704,085 A 1/1998 Sabalaskey
5,787,532 A * 8/1998 Langer et al. ..... 5/717
5,819,631 A 10/1998 Denney
D416,426 S 11/1999 Denney et al.
D416,739 S 11/1999 Denney et al.
D416,740 S 11/1999 Denney et al.
D416,741 S 11/1999 Denney et al.
5,974,609 A * 11/1999 Nunez et al. ..... 5/721 X
6,003,179 A * 12/1999 Farley ..... 5/736
6,023,803 A * 2/2000 Barman ..... 5/716
6,041,459 A * 3/2000 Nunez et al. ..... 5/730
6,128,798 A * 10/2000 Barman et al. ..... 5/716
6,142,053 A 11/2000 Denney et al.
6,263,533 B1 * 7/2001 Dimitry et al. ..... 5/717
6,292,965 B1 * 9/2001 Gambrell ..... 5/716
6,308,354 B1 * 10/2001 Lilly et al. ..... 5/721
6,360,390 B1 * 3/2002 Bonaddio ..... 5/717
6,442,780 B1 * 9/2002 Phillips et al. ..... 5/730
2003/0097715 A1 * 5/2003 Barman ..... 5/716
2003/0150016 A1 * 8/2003 Farley ..... 5/736

* cited by examiner

SINGLE PIECE FOAM TOPPERS WITH PERIMETER AREAS HAVING VARIABLE SUPPORT AND FIRMNESS PROPERTIES

FIELD OF THE INVENTION

The present invention pertains generally to resilient support devices, foam structures, and support devices which include foam structures as an integral component.

BACKGROUND OF THE INVENTION

In many resilient support structures, such as seating, bedding, and padding applications, foam is used as either the principle shock or load absorbing material, or in combination with a resilient structure such as an array of springs as a topper layer over the ends of the springs. This is commonly done in furniture and mattresses, wherein one or more foam layers overlie a spring array. The foam in this type of application is typically in slab-like form, with planar surfaces which rest upon supporting springs and over which covering or upholstery is laid. In some upholstered applications, such as automobile seating, the foam may be molded or otherwise contoured to a particular shape. For a single support surface, such as the planar sleeping surface of a mattress, a single unibody slab of foam is used to cover the entire surface.

Some attempts have been made to create foam layers which have differing support characteristics. For example, U.S. Pat. No. 5,579,549 describes a pad of fibrous material which is coated with adhesive material in designated areas to alter the firmness of the mattress in those areas. U.S. Pat. No. 5,604,021 describes a multi-layer support pad with regions of differing firmness formed by various layers of convoluted or sculpted foam in combination with underlying slab layers of foam. U.S. Pat. No. 5,701,623 describes a mattress topper having a latex foam core surrounded by border sections of adhesively attached synthetic urethane foam of different density than the latex. U.S. Pat. No. 5,704,085 describes a foam layer in a mattress which has an edge of foam attached by adhesive about a perimeter of a foam layer, wherein the edge foam is of a different type, such as polyurethane which is firmer than the center foam to which it is attached, such as latex. These latter three approaches require the manufacture and assembly of several different pieces of different material, each having a different "SKU" number and adding to inventory and production costs.

Relatively recent innovations in foam technology have enabled commercial production of contoured or sculpted foam, and undulating surfaces with peaks and valleys in the foam surface. This can be done with specialized cutting equipment in which blades of various designs create contours in the foam surface, as described for example in U.S. Pat. Nos. 4,683,791; 5,191,824; 5,819,631; 6,142,053 and 6,176,164. Contouring or cutting away portions of the surface of foam changes the support characteristics of the foam in a layered application, even when upholstery or other padding layers are placed over the foam. In the planar or slab-like layers of foam used in mattresses, the layers are dimensioned to cover the entire area of the mattress, or to cover the entire underlying spring array, and any contour or shaping is done across an entire surface area of the layer, giving the layer a modified but uniform support characteristic.

SUMMARY OF THE INVENTION

The present invention provides shaped, contoured or sculpted foam for use as a load bearing layer which has variable support characteristics selectively formed about different areas of the layer. Variations in the topical form of the foam are created by patterned voids formed by removal of foam material from an otherwise uniform or planar surface. This type of unibody, multi-dimensional foam layer, when combined with underlying support and topical layers, provides a support system with differing support or feel characteristics corresponding to the areas of differing foam contour.

In accordance with one general aspect of the invention, there is provided a thick comforting upholstery layer for use in a mattress construction where the center section of the layer has foam contoured or extracted in a pattern that results in the foam's physical properties (important to its cushioning behavior such as ILD and SAG factors) are potentiated, while the outer sides of the layer are left intact. In this manner the foam has supportive firm properties along the sides, while the center or main part of firm provides for a soft or conforming structure. This differential in firmness and support provides for a mattress of exceptional comfort while offering a supporting seating edge. It also results in an effectively larger useful sleeping area by providing increasingly supportive foam along the mattress sides. This unique structure is fabricated from one continuous piece of foam, which is more efficient and cost effective than piecing together dissimilar types of foam to form a single layer. Additionally, the transition from firm to soft can be easily graduated by the applied manufacturing processes so as to be unobtrusive (as compared to the abrupt interface between two different types of foam with different support properties). Additionally, the degree of differentiation in firmness and support can be easily varied over a broad range of desired values by using foams of substantially different properties (density, chemical, composition, ILD/IFD, SAG factor, etc.) and varying the amount/pattern of foam that is extracted by the applied manufacturing processes. In a preferred embodiment, a nominal thickness of a foam layer of the invention is in the range of one inch or greater, and the average density in an approximate range of 1.2 to 5.0 lbs./cu. ft. A preferred IFD approximate range is from about 25 to about 70 lbs./sq. in.

DETAILED DESCRIPTION OF PREFERRED AND ALTERNATE EMBODIMENTS

Figure 1:
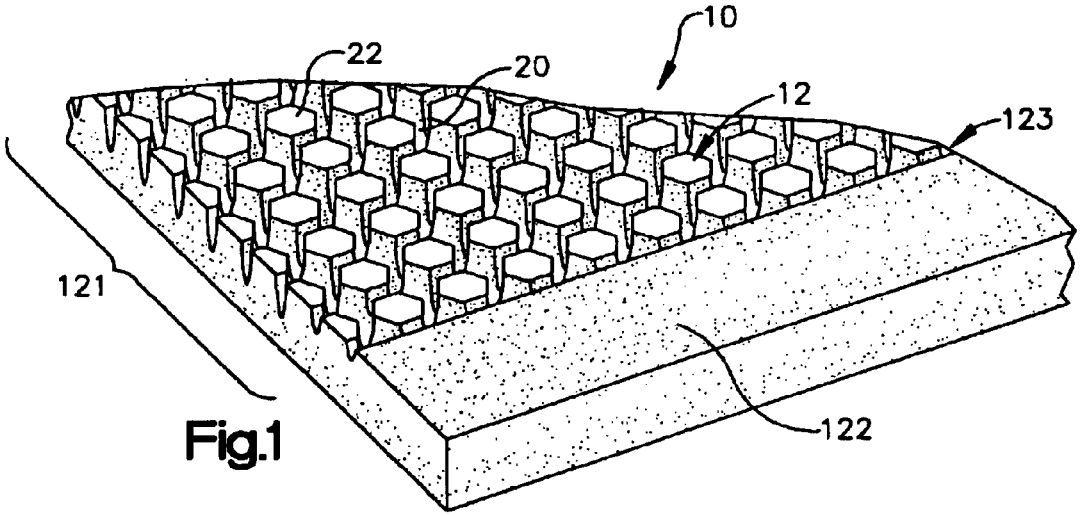
FIG. 1 is a perspective view of a single piece foam layer of the invention.
Figure 2:
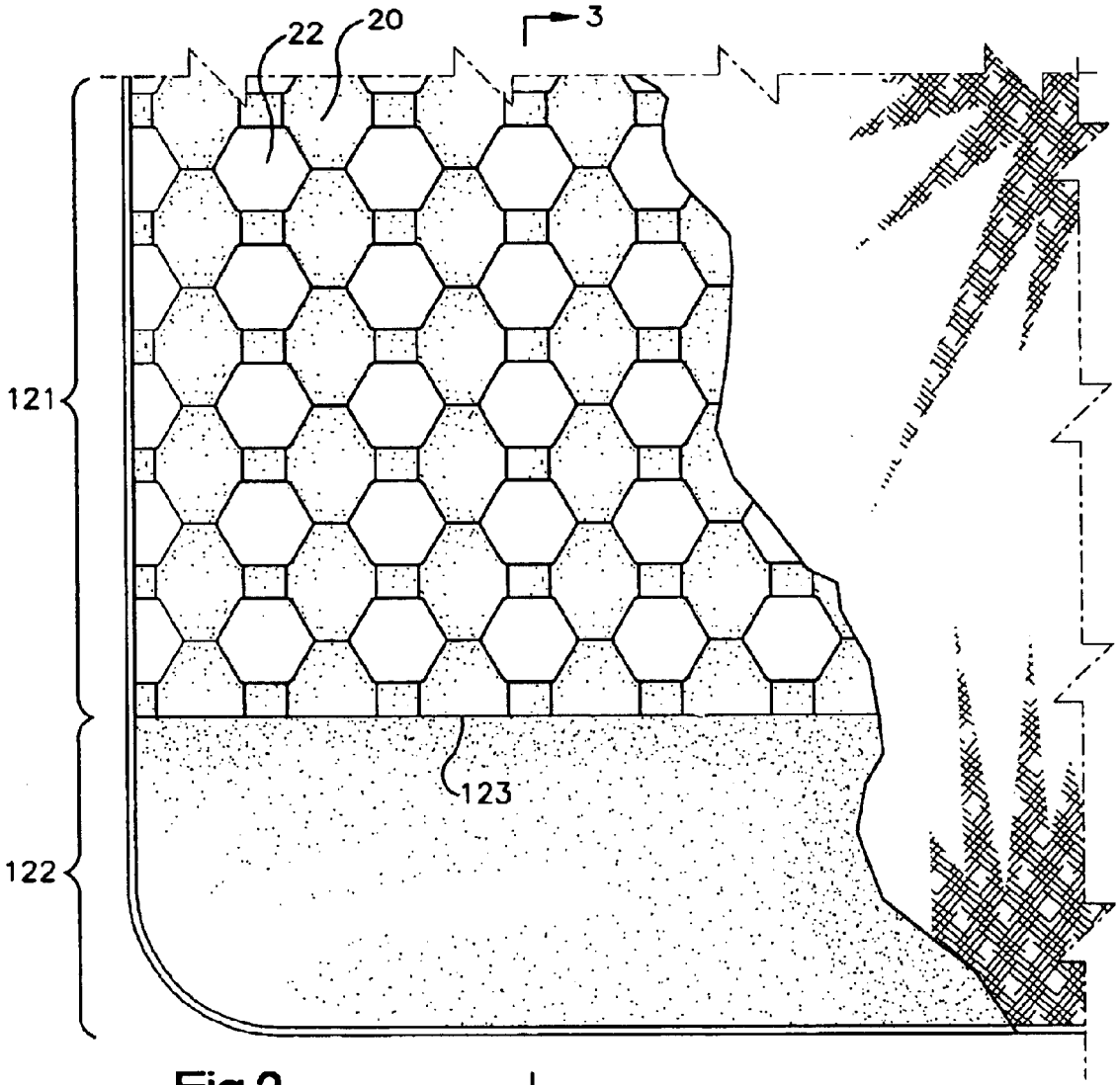
FIG. 2 is a top view of a single piece foam layer of the invention.
Figure 3:
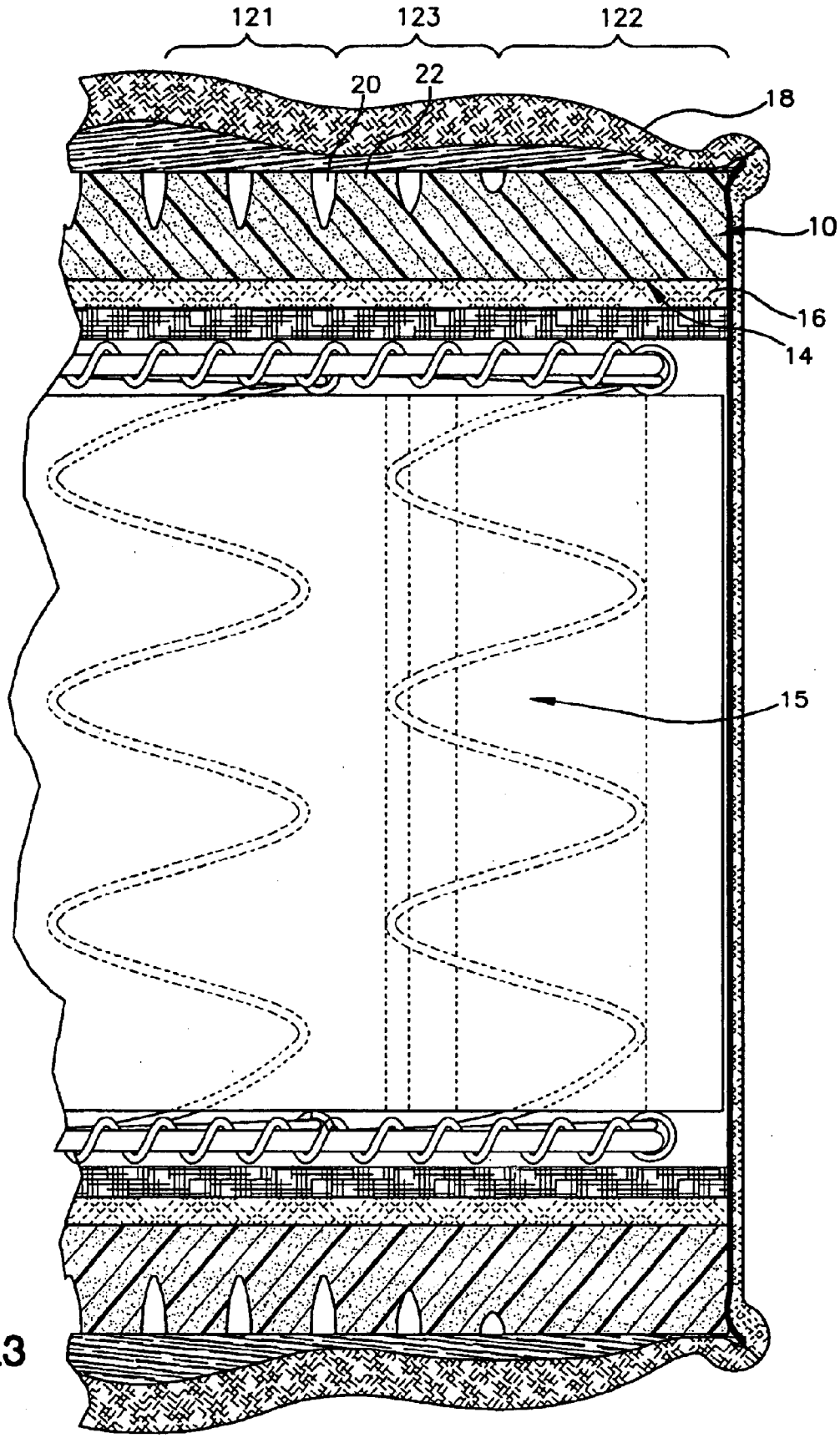
FIG. 3 is a cross-sectional view of a mattress construction incorporating a single piece foam layer of the invention.
Figure 4:
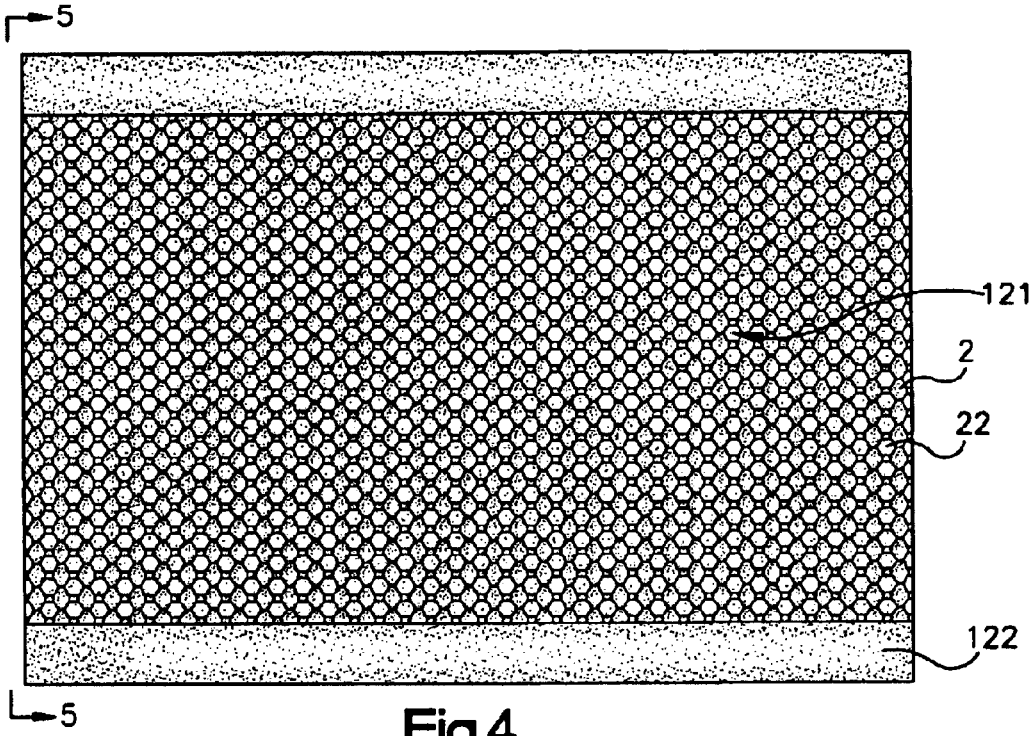
FIG. 4 is a top view of single piece foam layer of the invention.
Figure 5:
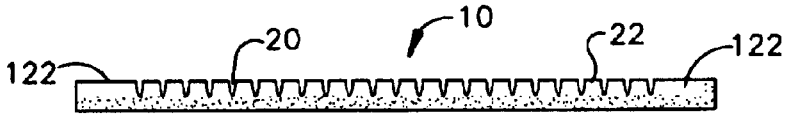
FIG. 5 is a side elevation of a single piece foam layer of the invention.
Figure 6:
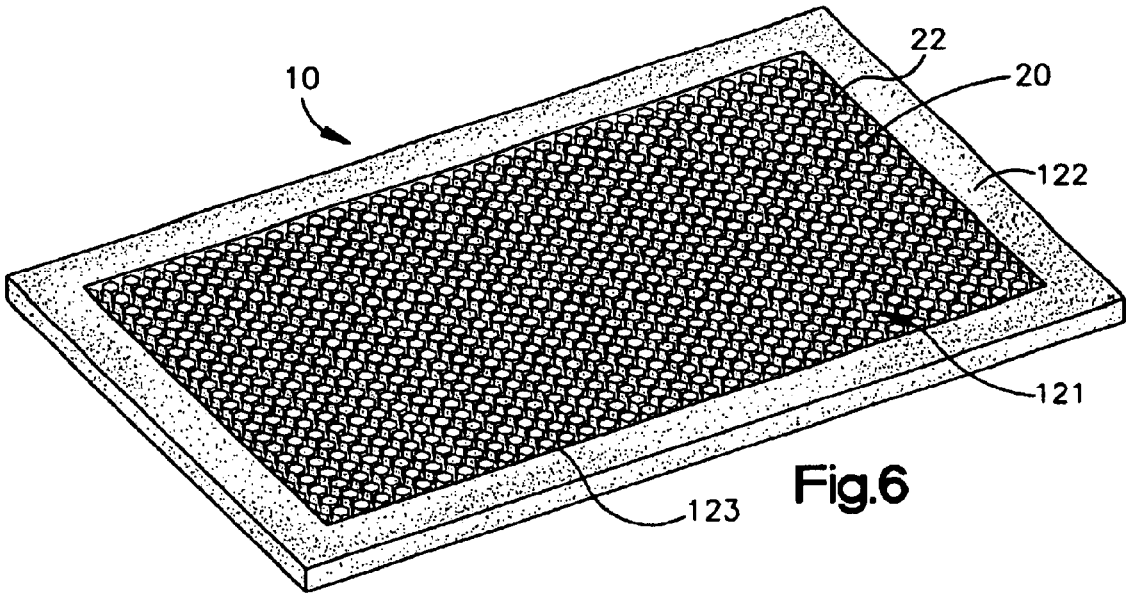
FIG. 6 is a top view of an alternate embodiment of a single piece foam layer of the invention.

With reference to the Figures, there is shown one embodiment of a single unibody foam piece, generally indicated at 10, which in this case is in the general form of a planar slab dimensioned to extend over a support surface area, such as the expanse of a mattress spring array or "innerspring", generally indicated at 15 in FIG. 3. As known in the industry, an innerspring is an array of individual coils or springs connected together so that axes of the coils are parallel and the ends of the coils provide a resilient support surface (as described for example in U.S. Pat. No. 4,726,572) and across which various layers of material, such as matting, foam and padding are laid to create a mattress. An external upholstery layer 18 is sewn over the innerspring and internal layers to complete the mattress. An underside 14 of the foam piece 10 may be generally smooth, for flush contact with an adjacent layer, which may be another internal layer or component of a mattress, such as a mat layer 16 between the foam and the springs. An upper side 12, which serves as the supporting or load-bearing side of the foam piece 10, is initially smooth or planar, as produced by a mold or extrusion process. Side 12 is then selectively contoured by various applicable processes, such as by automated cutting technology, etching, or other types of surface modification techniques, to selectively form different surface topographies. As used herein, the term "topography" refers to the relief features or surface configuration of an area or adjacent areas, in this case an area or areas of the foam layer of the invention.

The single unibody foam piece 10 has the physical characteristics of a single type of foam with homogeneous foam cell structure throughout the piece, with the differing surface topographies altering the aggregate density and ultimate support characteristics of the zones. This is very different from foam assemblies or structures which are made of combined pieces of foam of different materials and densities.

The sculpting or shaping of side 12 of the foam involves the removal of foam material in a pattern within one or more zones 121, 122, etc. An example of one type of foam removal pattern is a matrix of valleys or voids 20, and corresponding adjacent projections 22. The "projections" 22 extend generally from the bottom of the valleys or voids 20, so that it is the top or tip of the projections which collectively form a cushioned support surface, over which an upholstery layer is placed. The boundaries of the zones 121 can be defined according to design criteria. For example, in the case of foam piece 10 used as a layer in a mattress, zone 121 may be generally rectangular, covering a major expanse of the sleeping area, while adjoining zone 122 (having a different topography) is formed as lateral rail areas, or as a complete perimeter of the piece 10. In each such embodiment, zone 122 has a higher density than zone 121 as a result of less material being removed, and thus provides a firmer support as desired for edge seating function of the mattress. In this particular embodiment, zone 122 has a topography which is generally smooth and planar, i.e., no foam material has been removed from the surface of the rail sections. This results in the rail sections/zone 122 having a different or higher degree of firmness than the central zone 121, even though the layer 10 is formed as a single unibody piece. A higher degree of firmness at the longitudinal edges or entire perimeter of the mattress is desirable to provide a more functional sleeping and seating surface. Whereas a topper of uniform density tends to be excessively compressed at the edges and thus effectively reduces the effective sleeping area of the mattress, the higher density edge of zone 122 maximizes the support area of the mattress all the way to the edge of the underlying innerspring. Other than perimeter shaping, zones with varying topography can be laterally arranged to create a combination support mattress, or different zones head-to-toe.

Another aspect of the invention which improves the performance of the foam topper layer of a mattress, is that the foam topography modification may be configured to have gradual transitions between areas of differing topographies and resultant densities. For example, in the case of a zone with a surface topography having multiple projections, which merges with a zone with a generally flat topography, the projections of the first zone can be made to decrease in height or depth as they approach the flat second zone, so that the transition in firmness is less perceptible when felt through the upholstery layers. This is illustrated in one form as transition zone 123 in FIG. 3. In this same manner, multiple zones of differing density can be made in a single layer, with graduated transitions between the zones, so that the transitions from one foam density to another foam density are less perceptible through the overlying upholstery.

The invention thus provides an improved mattress component and mattress wherein the support characteristics of a principle padding element of the mattress is precisely controlled by patterned removal of foam from the support surface of the single piece foam layer. A single unibody component in a responsive flexible support structure has distinct zones with distinct support characteristics, the zones corresponding in location with the anticipated loads and loading patterns of a flexible support device in use. Foam materials suitable for the practice of this invention include any of the latex or polyurethane varieties, adaptable to the described foam cutting processes which form the varying topographies.

The following is claimed as the invention:

1. A single piece sculpted foam mattress layer for use as a cushioning layer in a mattress having an innerspring assembly and layers of material adjacent to the innerspring assembly wherein one of the layers is the sculpted foam layer, the innerspring assembly having a generally rectangular support surface and a rectangular perimeter about the support surface, the rectangular perimeter having opposed lateral rail edges the sculpted foam mattress layer having a generally rectangular shape which corresponds to a rectangular support surface of an innerspring assembly, the foam layer having parallel rail sections dimensioned to overlie the perimeter of the innerspring assembly, the rail sections having a generally smooth surface topography, and adjoining a central section of the foam layer which has a contoured surface topography, and wherein the topography of the central section is graduated proximate to edges of the rail sections and the density of the central section gradually increases proximate to the rail sections, and wherein the rail sections have a material density greater than a material density of the central section.

2. A single piece sculpted foam mattress layer for use as a cushioning layer in a mattress having an innerspring assembly and layers of material adjacent to the innerspring assembly wherein one of the layers is the sculpted foam layer, the innerspring assembly having a generally rectangular support surface and a rectangular perimeter about the support surface, the rectangular perimeter having opposed lateral rail edges the sculpted foam mattress layer having a generally rectangular shape which corresponds to a rectangular support surface of an innerspring assembly, the foam layer having parallel rail sections dimensioned to overlie the perimeter of the innerspring assembly, the rail sections having a generally smooth surface topography, and adjoining a central section of the foam layer which has a contoured surface topography, and wherein the topography of the central section is graduated proximate to edges of the rail sections and the density of the central section gradually increases proximate to the rail sections, and wherein the rail sections have an ILD rating greater than an ILD rating of the central section.

3. A single piece sculpted foam mattress layer for use as a cushioning layer in a mattress having an innerspring assembly and layers of material adjacent to the innerspring assembly wherein one of the layers is the sculpted foam layer, the innerspring assembly having a generally rectangular support surface and a rectangular perimeter about the support surface, the rectangular perimeter having opposed lateral rail edges the sculpted foam mattress layer having a generally rectangular shape which corresponds to a rectangular support surface of an innerspring assembly, the foam layer having parallel rail sections dimensioned to overlie the perimeter of the innerspring assembly, the rail sections having a generally smooth surface topography, and adjoining a central section of the foam layer which has a contoured surface topography, and wherein the topography of the central section is graduated proximate to edges of the rail sections and the density of the central section gradually increases proximate to the rail sections, and wherein the rail sections have an IFD rating greater than an IFD rating of the central section.

* * * * *